US006725623B1

(12) United States Patent
Riddell et al.

(10) Patent No.: US 6,725,623 B1
(45) Date of Patent: Apr. 27, 2004

(54) STANDING SEAM METAL ROOF WIND UPLIFT PREVENTION BAR

(75) Inventors: Richard A. Riddell, Littleton, CO (US); Paul A. Riddell, Highlands Ranch, CO (US); Jason T. Nagaki, Highlands Ranch, CO (US); Steve S. Sherman, Denver, CO (US)

(73) Assignee: Action Manufacturing, LLC, Englewood, CO (US)

( * ) Notice: Subject to any disclaimer, the term of this patent is extended or adjusted under 35 U.S.C. 154(b) by 34 days.

(21) Appl. No.: 09/713,618

(22) Filed: Nov. 15, 2000

(51) Int. Cl.[7] ..... E04B 7/18
(52) U.S. Cl. ..... 52/750; 52/25; 52/542
(58) Field of Search ..... 52/24, 25, 167.1, 52/542, 545, 750

(56) References Cited

U.S. PATENT DOCUMENTS 5,271,194 A 12/1993 Drew
5,715,640 A 2/1998 Haddock

OTHER PUBLICATIONS

Author: Action Manufacturing, LLC Title: Snobar, 2 pages dated Oct. 1997.

*Primary Examiner*—Robert Canfield
(74) *Attorney, Agent, or Firm*—Margaret Polson; Patent Law Offices of Rick Martin, P.C.

(57) ABSTRACT

Both positive and negative wind loads acting on the surfaces of standing seam roofing often exceed the design capabilities of a particular metal roof, causing the standing seam interlocking vertical seams to disengage. This often results in the roof panels blowing off the roof, causing damage to the roof, the building contents and possible danger to people in the vicinity. A transverse bar is provided across the standing seams of the metal roof. Clamps hold the transverse bar onto the standing seams. At the midsection of each flat panel section of the metal roof a brace descends from the transverse bar. The brace must have a flexible foot member to press down on the panel, otherwise the brace would puncture or otherwise damage metal roof panel. The brace may have an adjustable height adjustment mechanism. Various clamp, bar and foot embodiments are disclosed, all of which provide a structural anti-lift bracket on the roof panel.

34 Claims, 11 Drawing Sheets

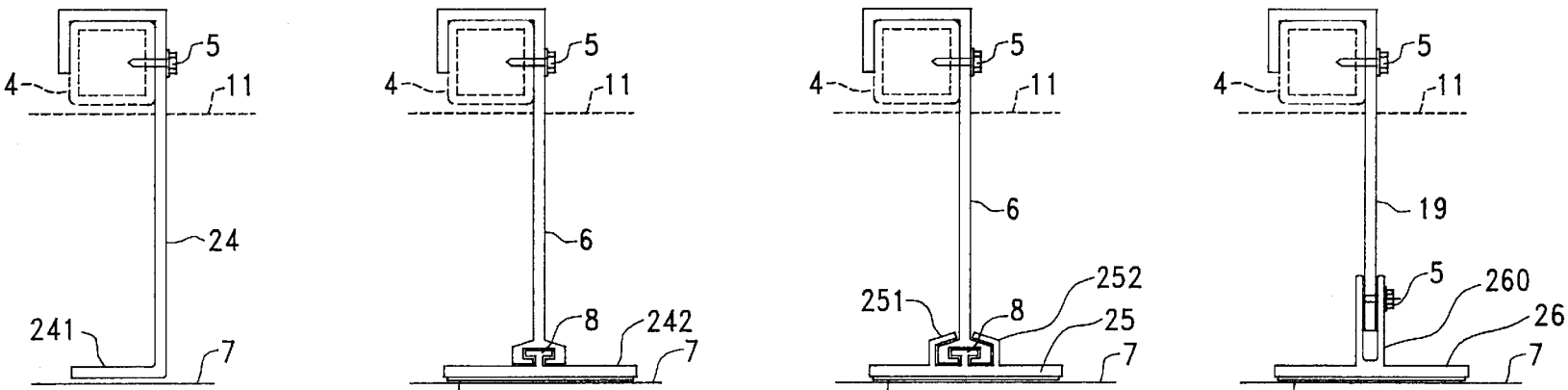
FIG. 15
FIG. 16
FIG. 17
FIG. 18
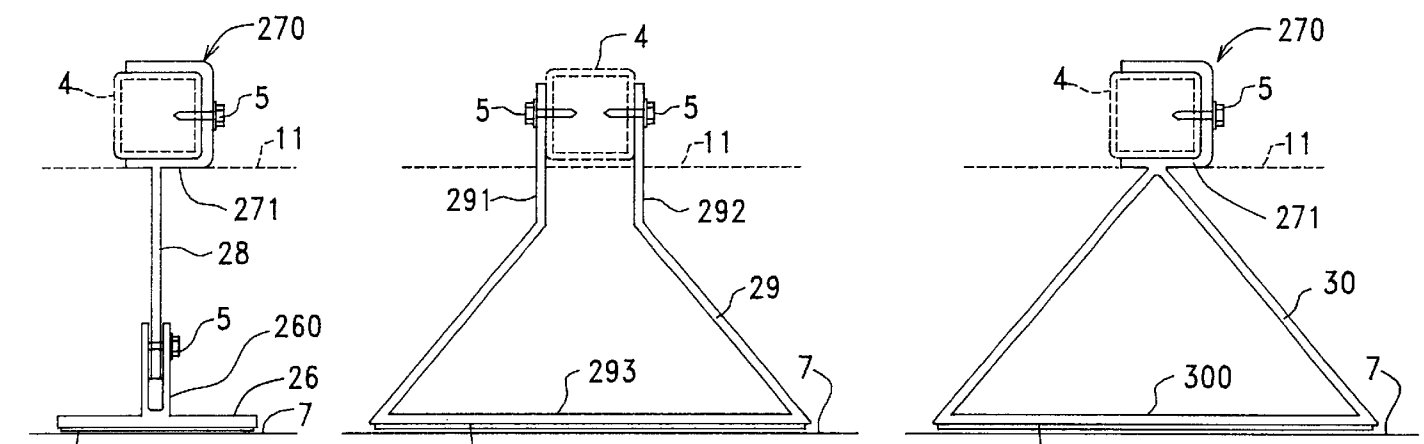
FIG. 19
FIG. 20
FIG. 21
FIG. 22

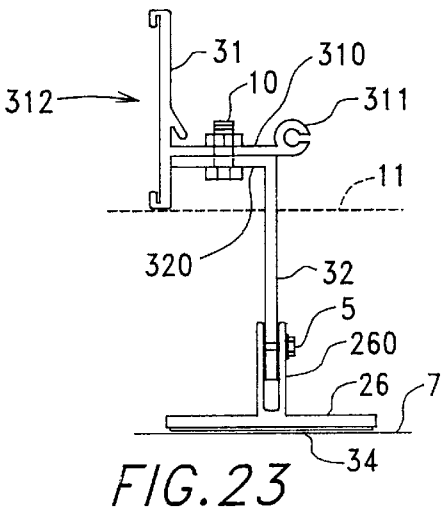
FIG. 23
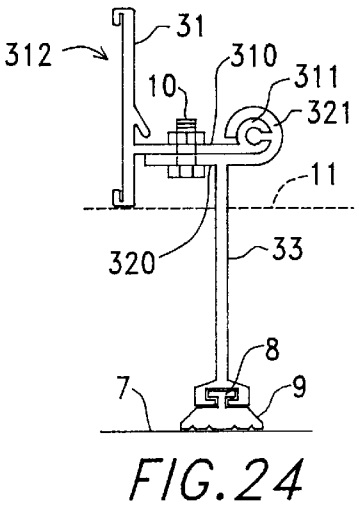
FIG. 24
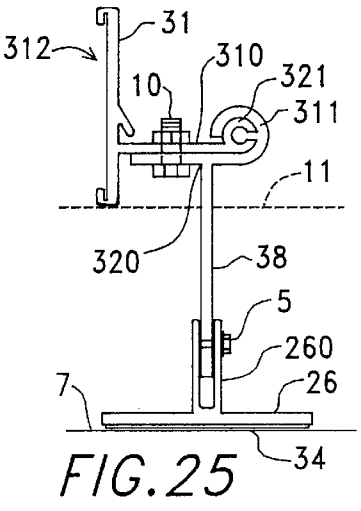
FIG. 25
FIG. 26
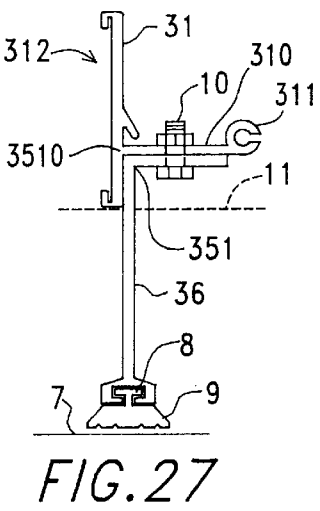
FIG. 27
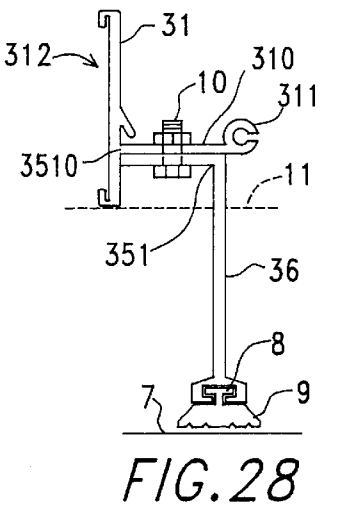
FIG. 28
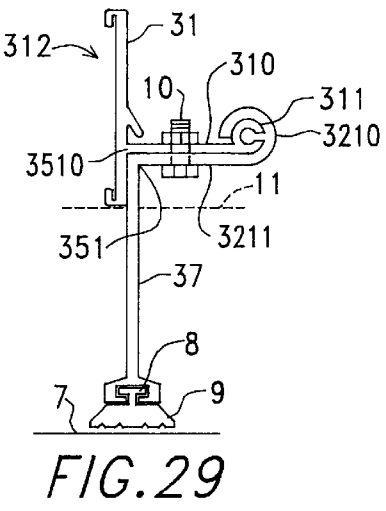
FIG. 29

STANDING SEAM METAL ROOF WIND UPLIFT PREVENTION BAR

FIELD OF THE INVENTION

The present invention relates to a metal roof having interlocking standing seams which can disengage in heavy winds, wherein a transverse bar is provided across the standing seams, the transverse bar being clamped to the standing seams, and the transverse bar having a series of downward extending brackets each of which has a flexible foot to press down on the flat panels of the roof, thereby providing a structural brace to hold the panels down in a heavy wind.

BACKGROUND OF THE INVENTION

Metal roofs formed by interconnected metal panels can be susceptible to uplift and tearing due to lifting forces caused thereon by blowing winds. Such wind blown metal panels can be hazardous to nearby people and property. For example, during particularly windy conditions, metal panels can detach or tear from the metal roof and injure passers-by. As such, and with the increased use of metal panels in building construction, there has been an increased need to address ways in which to simply and conveniently control the uplift of such metal roofs.

In addition, in various climates it may be desirable to position a snow retention device on a metal roof to control/inhibit/impede the movement of snow and/or ice down the pitch of the roof.

Sliding snow and/or ice from roofs can be hazardous to people, the surrounding landscape, property, and building components. For example, snow or ice sliding from a roof above an entryway may injury passers-by. Similarly, falling snow or ice can be damage to landscape features, such as shrubs, and property or building components, including automobiles or lower roofing portions. In addition, sliding snow or ice can shear off antennas, gutters or other components attached to a building roof or wall, thereby potentially causing a leak. The problem of sliding snow or ice is particularly experienced in connection with metal roofs, including raised seam roofs (e.g. standing seam), where there is relatively little friction between the roof and the snow or ice. As used herein, the term "raised seam roofs" includes roofs formed by a series of panels interconnected to define longitudinal, raised portions. It may, therefore, be desirable to provide a guard suitable for controlling movement of snow and/or ice across/along selected areas of such metal roofs.

The forerunner of the present invention is the snow retention device taught in U.S. Pat. No. 5,271,194 (1993) to Drew.

The device used in the '194 method of preventing sheets of snow from falling from sheet metal roofs comprises a plurality of attachment mechanisms, each capable of supporting a bar which extends perpendicular to the roof seams. The attachment mechanisms are generally U-shaped, with two prongs and an apex. Thus, the attachment mechanisms may fit around a variety of different widths of roof seams. Furthermore, the attachment mechanisms will conveniently fit around roof seams which are broader at one point than another, such as a seam that is broader at the top than at the point of connection to the roof.

To facilitate securing the attachment mechanisms to roof seams, a hole is provided in one or both prongs of each attachment mechanism, for received an attachment screw. The attachment screw has a blunt tip which will not penetrate the roof seam as the attachment screw is tightened to hold the attachment mechanism in place next to the roof seam.

The '194 method of preventing large sheets of snow from falling off roofs involves attaching a plurality of attachment mechanisms to roof seams. It is not essential that every roof seam be fitted with an attachment mechanism, as long as sufficient attachment mechanisms are connected to roof seams to provide support for the bar to be held in place by the attachment mechanisms. The attachment mechanisms should be aligned so that the bar may be placed adjacent to the apex of each attachment mechanism. The next step in the '194 method is to connect the bar to the attachment mechanisms. This may be accomplished by screwing, welding, or otherwise connecting the bar directly to the apex of each attachment mechanism, holding the bar essentially perpendicular to the roof seams and adjacent to said apexes while the connections are being made.

A more convenient method of connecting the attachment mechanisms to the bar may be utilized. In this method, each attachment mechanism is provided with a bar receiving channel, connected to the apex of the attachment mechanism prior to connecting the attachment mechanisms to the roof seams. This channel is designed to snugly receive the bar, so that the bar may be placed into plurality of channels to hold the bar in its desired position with respect to the roof. Thus, once the attachment mechanisms are attached to the roof seams, the bar may be placed into the channels which hold the bar in place.

To further secure the bar in its desired location, a securing screw may be inserted through one or more of the channels into the bar. A hole may be provided in each channel to facilitate placement of the securing screw. The securing screw may be inserted through the channel opposite the connection of the channel to the apex of the U-shaped attachment mechanism. Alternatively, if more convenient, the securing screw may be inserted through the apex of the U-shaped attachment mechanism, through the channel at its point of connection to that apex, and into the bar.

Use of attachment mechanisms with bar receiving channels facilitates installation of this device for preventing sheets of snow from falling in a number of ways. Even when roof seams are spaced with differing distances between adjacent seams, use of separate attachment mechanisms enables the mechanisms to be quickly installed without modification. Then, the bar may be conveniently placed in the channels of each attachment mechanism, again with no modification required to adjust for differing distances between adjacent roof seams. Similarly, the bar may be easily placed into the channels without regard for the size or shape of each individual seam, differences in which are accommodated by placing each U-shaped attachment mechanism over the seam with a prong on either side of the seam.

Another advantage of the '194 invention is that the bar may be easily removed from the attachment mechanisms. If a significant build-up of snow occurs, it may be desirable to push that snow off the roof at a time when the area beneath the roof can be cleared of anyone or anything that might be hurt by the snow. The bar can be removed at such a time, the snow pushed off the roof, and the bar easily reinserted into the channels of the attachment mechanism.

The '194 system has also been improved for snow retention purposes to include a downward depending bracket located between the standing seams and fastened to the transverse bar. In the marketplace this bracket has been called the optional ice stopper. The bottom edge of the optional ice stopper consists of a narrow elongate edge of the metal body of the ice stopper. This narrow elongate edge if used as an anti-lift mechanism for the roof panels would puncture or otherwise damage the thin gauge metal roof panels.

Therefore, what is needed to upgrade the basic structure of the '194 patent with the optional ice stopper is a foot for the downward depending bracket. The foot needs to spread the downward force of the bracket during high winds across a large enough surface area of the roof panel to prevent damage to the roof panel. The present invention teaches several embodiments of an adequate foot design.

The preferred embodiment uses a neoprene pedastal as the foot, wherein the pedastal has a groove to fit under the bracket's lower edge. The resultant device provides structural integrity to the center of the roof panel for prevention of uplift during high winds. A plurality of transverse bars are used across the entire roof for this wind uplift prevention system. In some climates such as Boulder, Colorado the invention serves both as a wind uplift prevention system and a snow retention system.

SUMMARY OF THE INVENTION

The primary aspect of the present invention is to provide a plurality of transverse bars across the tops of standing seams of a metal roof, wherein each bar supports a downward depending structural brace against a portion of a roof panel, thereby preventing wind uplift of the panel while not causing harm to the panel.

Another aspect of the present invention is to provide each brace with a foot designed to push down on the flat roof panel without damaging the flat roof panel.

Other aspects of this invention will appear from the following description and appended claims, reference being made to the accompanying drawings forming a part of this specification wherein like reference characters designate corresponding parts in the several views.

The present design incorporates a clamp that fits 95% of the architectural and structural standing seams on the market. The system consists of a 12 gauge stainless steel clamp which holds a 16 gauge 1"×1" stainless steel bar that is fastened to the clamp. The downward braces that hang from the bar in the center of the panel prevent wind uplift without injury to the panel. They can also be used to prevent ice from sliding under the bar on high structural seams or over entryways where more protection is needed.

The system is not only a clamp but is also a bar. By incorporating a 16 gauge stainless bar which is strong enough not to deflect between the seams, and using a clamp at every seam, the system creates a very rigid grid that if properly engineered will hold down a metal roof even in a hurricane.

All the embodiments provide a clamp and a bar assembly (s) for controlling the amount of upward deflection of the flat of the panel of a standing seam metal roof system, thereby preventing the interlocking seams of the roof system from deforming and disengaging.

The preferred embodiment consists of a plurality of clamping devises that attach to the vertical seams of a standing seam metal roof and fastens to those seams with a blunt tip screw(s) that will not penetrate the standing seam. These clamping devises incorporate a U-shaped yoke to receive a structural bar of size designed to span between the specific seam spacing and running perpendicular to the standing seams. The bar is snuggly fit into the yoke of the clamp assembly and is further attached to the clamp through one of its sides with two or more screws.

The bar securely fastens to the clamping device which are themselves attached to the vertical seams of the roof. The bar can now act as a structural support for the wind uplift brace that attaches to the bar/clamp assembly. This brace which can vary in its length is shaped in a "U " fashion so as to drop over the bar in a snug fit; it's vertical leg extending down to the flat of the standing seam panel. The brace is then fastened to the bar with two screws. This can be of different shapes and designs to facilitate the various dimensions, depths and configurations of the many manufacturers of metal standing seam roofing. The brace will be positioned approximately in the middle of the distance between the individual standing seams. Although some applications may use multiple braces across one panel span. The base of the foot brace may contain a receiving slot for a rubber, neoprene, nylon or plastic foot to prevent it from marring the surface of the metal roof. The base of the foot may or may not touch the surface of the roof panel, but will be no more than ½" from the flat portion of the panel. The purpose of the foot is to prevent the flat of the panel from being forced up by the positive and negative pressures of high velocity winds blowing over the surface of the roof panels. These pressures will be transferred through the foot to the brace and in turn to the bar and finally into the clamp which are securely fastened to the seams. By reducing the deflection of the flat of the panel you will prevent the spreading of the standing seam interlock and thereby prevent its eventual deformation and disengagement.

The frequency or occurrence of the rows of bar assemblies up the roof will be determined by the roof type, style, and roof support spacing. In most cases a plurality of bar assemblies will occur over each support or in the mid-span of the roof panels between the roof supports.

BRIEF DESCRIPTION OF THE DRAWINGS

FIG. 15 is a left side plan view of an alternate embodiment brace.

FIG. 16 is a left side plan view of an alternate embodiment brace.

FIG. 17 is a left side plan view of an alternate embodiment brace.

FIG. 18 is a left side plan view of an alternate embodiment brace.

FIG. 19 is a left side plan view of an alternate embodiment brace.

FIG. 20 is a left side plan view of an alternate embodiment brace.

FIG. 21 is a left side plan view of an alternate embodiment brace.

FIG. 22 is a left side plan view of an alternate embodiment brace.

FIG. 23 is a left side plan view of an alternate embodiment brace.

FIG. 24 is a left side plan view of an alternate embodiment brace.

FIG. 25 is a left side plan view of an alternate embodiment brace.

FIG. 26 is a left side plan view of an alternate embodiment brace.

FIG. 27 is a left side plan view of an alternate embodiment brace.

FIG. 28 is a left side plan view of an alternate embodiment brace.

FIG. 29 is a left side plan view of an alternate embodiment brace.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF DRAWINGS

Figure 1:
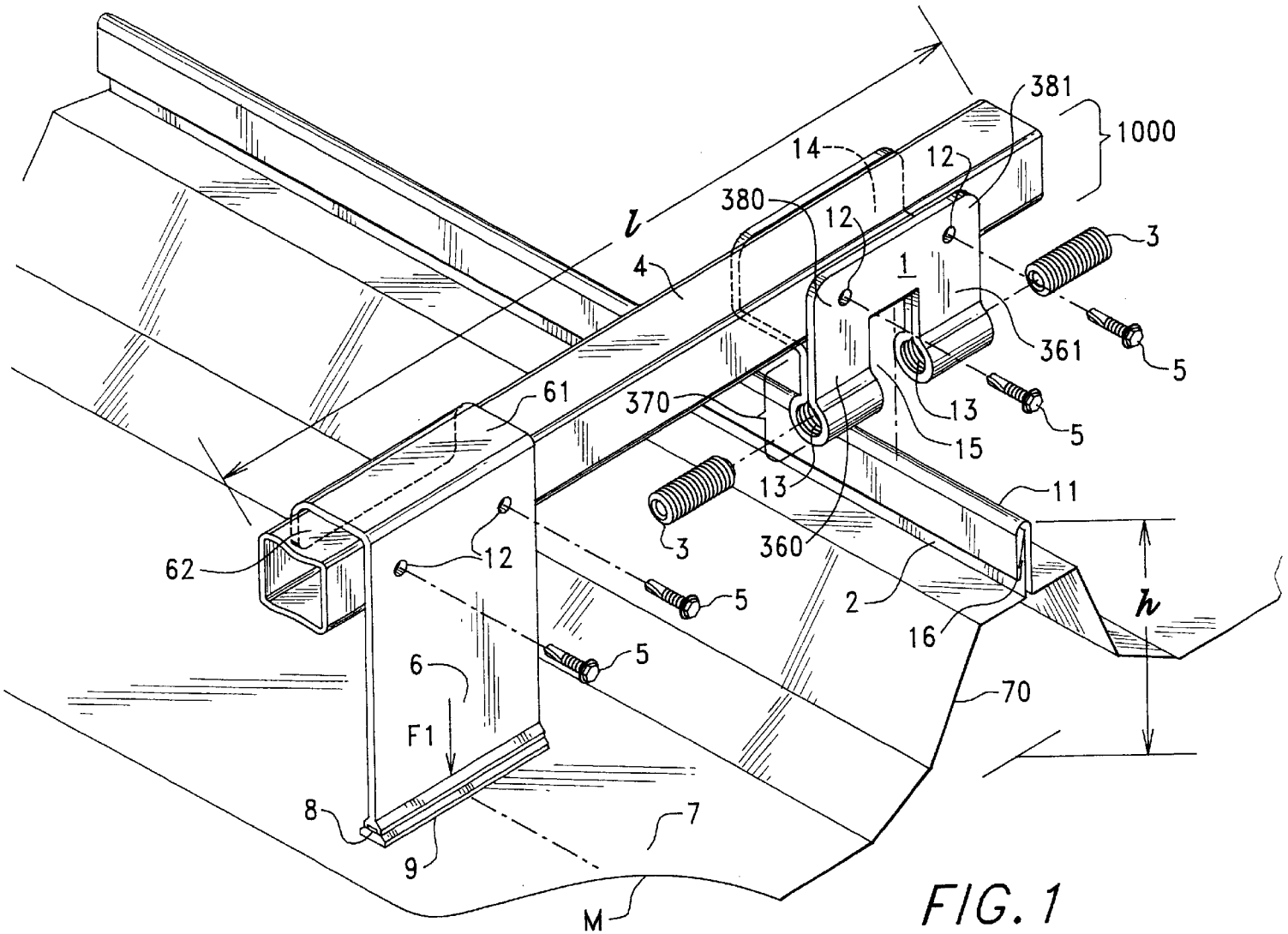
FIG. 1 is a top perspective view of the preferred embodiment anti-uplift device.

Referring first to FIG. 1 the preferred embodiment uplift prevention safety system 1000 is shown mounted on a metal roof having panels 7, a standing seam 70 having a verticle flange 2 and an interlock 16 of the flange 2 of the standing seam 70. The top of the standing seam 70 is numbered 11. Preferably each standing seam 70 will have a clamp 1 attached thereto. The preferred clamp 1 is made of 12 gauge stainless steel but could be made of cast aluminum or brass. Threaded holes 13 of the base 370, having legs 360,361, of the inverted U-shaped saddle 15 of clamp 1 receive blunt nosed screws 3 which fasten the clamp 1 to the standing seam 70 at seam flange 2.

A U-shaped channel 14 receives a transverse bar 4 which is made preferably of 16 or 14 gauge stainless steel or 16 or 14 gauge galvanized bar having dimensions of 1"×1" or 1"×1⅛". The transverse bar 4 has a length L great enough to span several standing seams 70. The transverse bar must withstand upward forces caused by wind uplift forces on the panels 7. Therefore, holes 12 in clamp flanges 380, 381 receive self drilling type screws 5 to fasten the transverse bar in the channel 14. A weld or other fastener could be used.

In order to prevent wind uplift of panel 7 a force F1 counters any such wind uplift force. Force F1 is applied at the midsection M of panel 7 unless multiple braces 6 are used to partition the forces F1 in thirds or in any manner an architect/engineer dictates.

The brace 6 shown has a top 61 and a distal flange 62 which provide a hanger to hang from the transverse bar 4. Holes 12 receive self drilling type screws 5 to fasten the brace to the transverse bar 4. The bottom of brace 6 has a slot 8 to receive the foot 9 which may be made of rubber, neoprene, nylon, or plastic. The area of the foot is calculated to distribute the uplift load without harming the panel, wherein known methods of calculations are used which consider metal type, gauge, spacing and uplift pressures.

Figure 4:
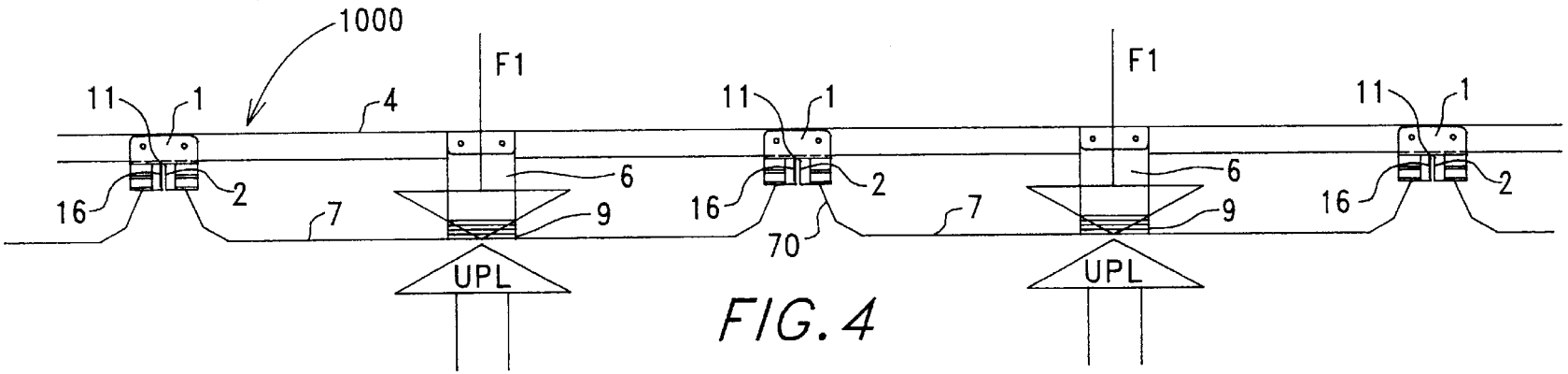
FIG. 4 is a front plan view of the preferred embodiment device shown in FIG. 1 preventing the wind uplift of the flat panels shown in FIG. 3.
Figure 3:
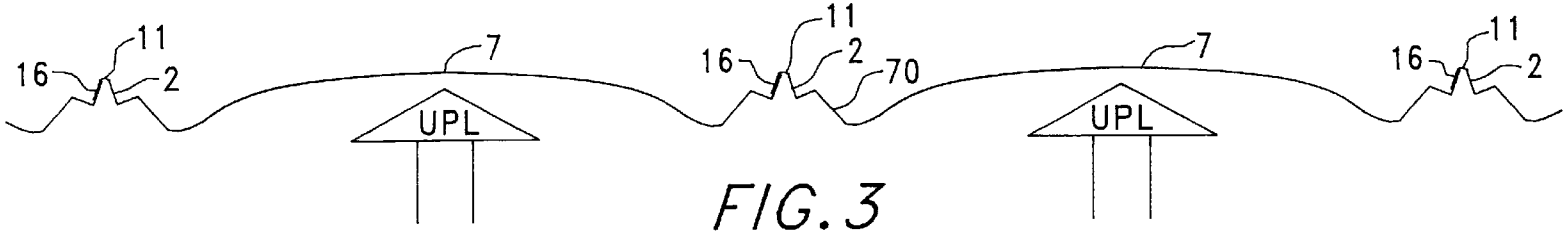
FIG. 3 (PRIOR ART)
FIG. 3 (prior art) is the same view as FIG. 2 showing a high wind lifting the flat panels of the roof.
Figure 2:
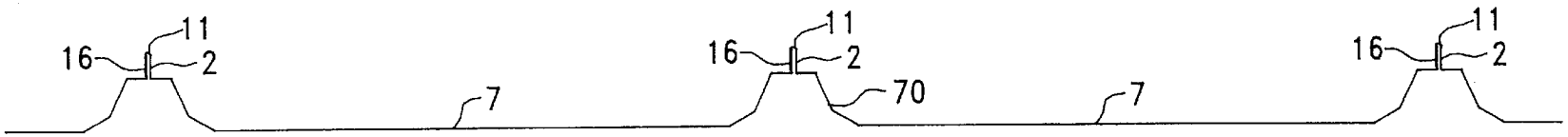
FIG. 2 (PRIOR ART)
FIG. 2 (prior art) is a front plan view of a standing seam metal roof.

Referring next to FIGS. 2,3,4 the problem of metal roofs and the solution is shown in sequence. FIG. 2 shows the panel(s) 7 without uplift pressure. FIG. 3 shows the uplift pressure UPL raising panel(s) 7 and unfolding the interlock 16 of standing seam 70. FIG. 4 shows how the device 1000 having brace 6 provides a force F1 adequate to counter force UPL, thus maintaining the panel 7 flat on the roof. It is shown that force F1 from brace 6 is at about right angles to panel 7.

Figure 5:
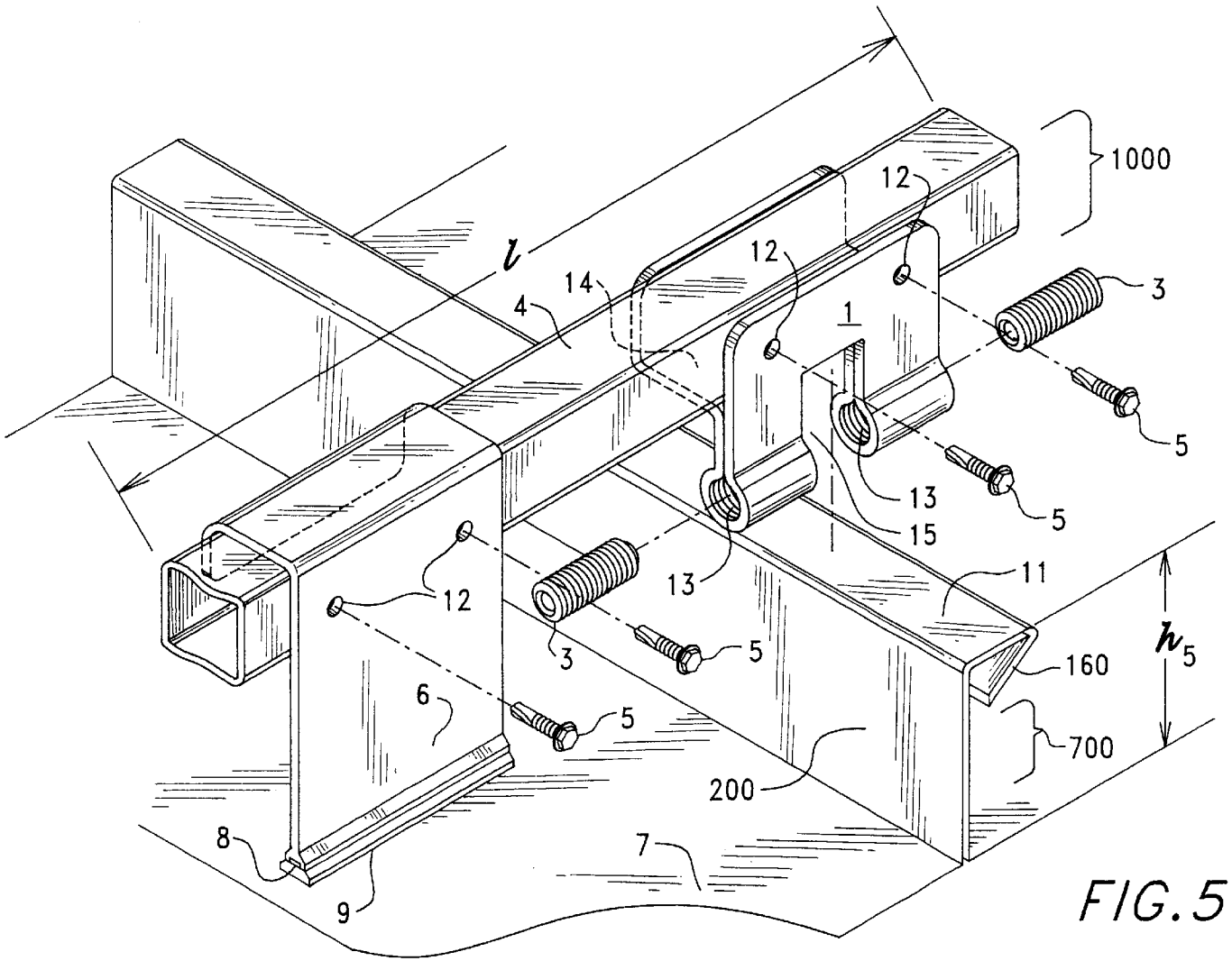
FIG. 5 is a top perspective view of the preferred embodiment device mounted on a vertical seam roof as opposed to a trapezoidal seam roof shown in FIG. 1.

Referring next to FIG. 5 a different style roof has the same panels 7. However, the standing seam 700 has a vertical flange 200 starting at the panel 7, and has a different interlock 160. Nominally the height $h_5$ is different from the roof in FIG. 1, and the top 11 is a different height. It can be seen the same clamp 1 accommodates this different roof style without any change to the functionality of the safety device 1000.

Figure 8:
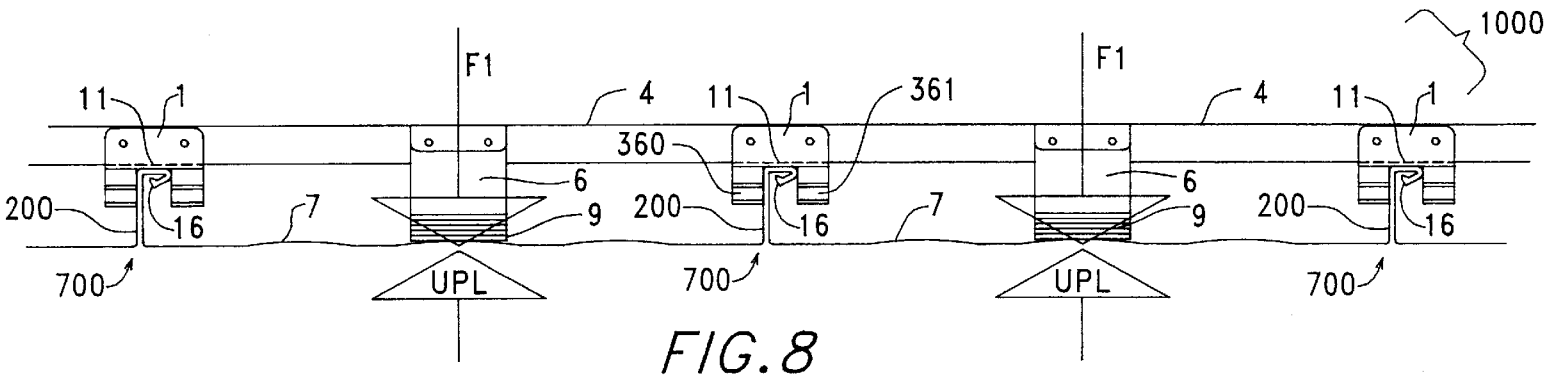
FIG. 8 is a front plan view of the preferred embodiment device preventing the wind uplift shown in FIG. 7.
Figure 7:
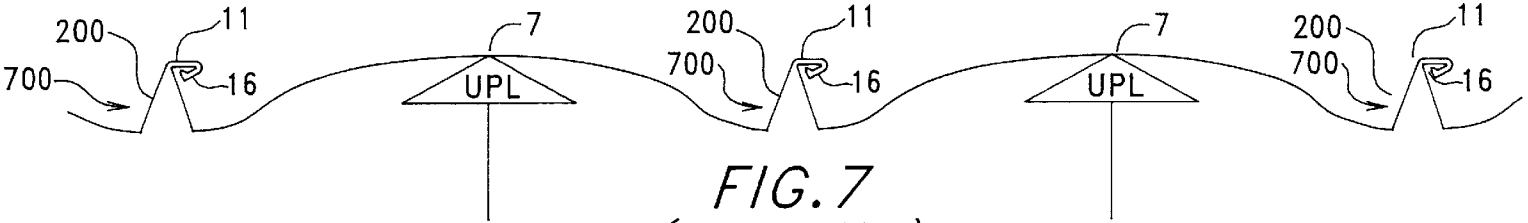
FIG. 7 (PRIOR ART)
FIG. 7 (prior art) is the same view as FIG. 6 under a high wind condition.
Figure 6:
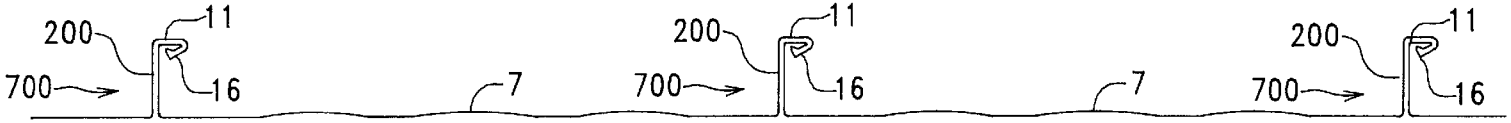
FIG. 6 (PRIOR ART)
FIG. 6 (prior art) is a front plan view of a vertical seam metal roof.

Referring next to FIGS. 6,7,8 the same structural force F1 is provided to meet the wind uplift force UPL.

Figure 9:
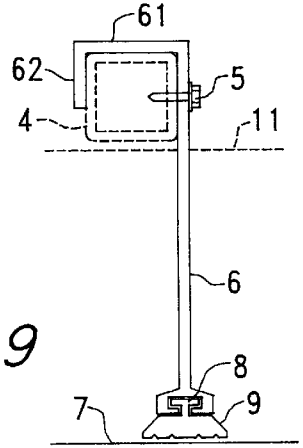
FIG. 9 is a left plan view of the brace shown in FIG. 1.

Referring next to FIGS. 9–34 a variety of braces are disclosed which accommodate a variety of transverse bars. FIG. 9 shows the embodiment of FIG. 1. It is a matter of design choice whether the foot 9 stays a little above panel 7 as shown or touches the panel. The key is that the foot 9 is adjusted to a height above the panel 7 small enough to prevent an uplift of the panel 7 which would be greater than the resilient return force in the panel 7. In summary the foot 9 prevents a permanent bend in the panel 7 during a wind uplift force. Design choices to leave a slight space may be chosen to accommodate thermal shifting of the panel 7 as well as to eliminate abrasion of the surface of panel 7.

Figure 10:
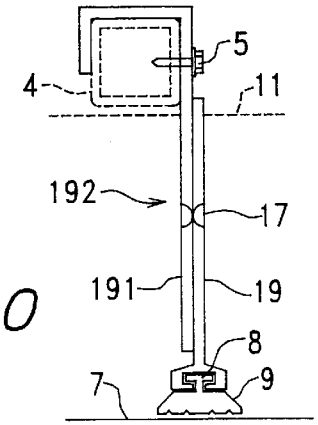
FIG. 10 is a left side plan view of an alternate embodiment brace.

FIG. 10 shows an adjustable height brace 192 having sections 191,19 welded at 17.

Figure 11:
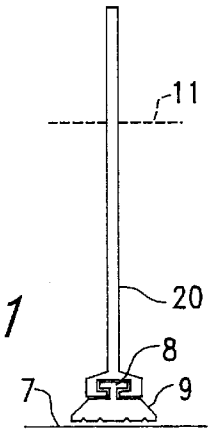
FIG. 11 is a left side plan view of an alternate embodiment brace.
Figure 12:
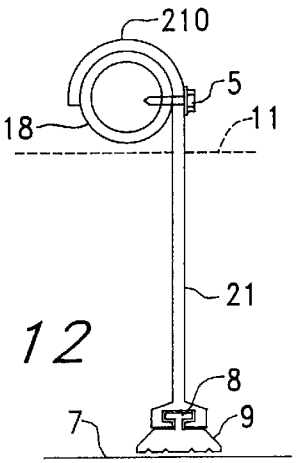
FIG. 12 is a left side plan view of an alternate embodiment brace.

FIG. 11 shows a straight brace 20 which could be welded, bolted or screwed to a variety of transverse bars. FIG. 12 shows a round transverse bar 18. A brace 21 has a curved top 210 to accommodate the round transverse bar.

Figure 14:
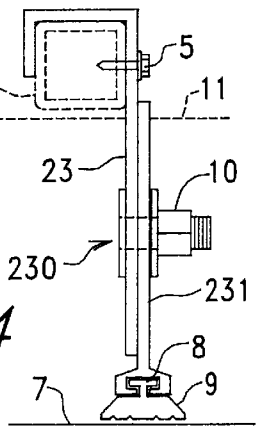
FIG. 14 is a left side plan view of an alternate embodiment brace.
Figure 13:
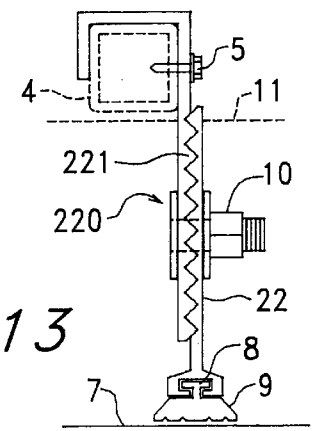
FIG. 13 is a left side plan view of an alternate embodiment brace.

FIG. 13 shows an adjustable height brace 220 having interlocking segments 221,22 joined by a nut and bolt 10. FIG. 14 shows an adjustable height brace 230 having segments 23,231 joined by a nut and bolt 10.

FIG. 15 shows a brace 24 having a foot 241 comprised of a ninety-degree flange made at the bottom of the vertical segment of the brace. FIG. 16 shows a brace 6 having a foot 242. The slot 8 secures a rigid (metal or plastic) foot 242 that has an optional soft coating 34 on its bottom surface (neoprene, Teflon®, rubber, plastic). FIG. 17 shows a brace 6 with slot 8, wherein the foot 25 has a channel 251,252 which surrounds the external housing for the slot 8. The foot 25 is preferably made of aluminum with the optional soft coating 34.

FIG. 18 shows a brace 19 that is simply a vertical segment. The foot 26 can have an adjustable height by inserting the brace 19 into the slot 260 and fastening screw 5.

FIG. 19 shows a brace 27 that pushes up into the center region of transverse bar 4 via C-shaped channel 270 and bottom C segment 271. This design reduces a twisting torque on transverse bar 4 and insures structural integrity even in the failure of screw 5. FIG. 20 shows the brace 28 having the C-shaped channel 270 but adapted to receive the variable height foot 26 shown in FIG. 18.

FIG. 21 shows a variable height brace wherein the collar 291,292 can be fastened at a desired height via screws 5. The foot 293 is a base of the triangular brace body 29.

FIG. 22 a triangular base body 30 having a foot 300 comprising the base of the triangle. The fixed height C-shaped channel 270 centers the uplift forces in the center of transverse bar 4.

Figure 30:
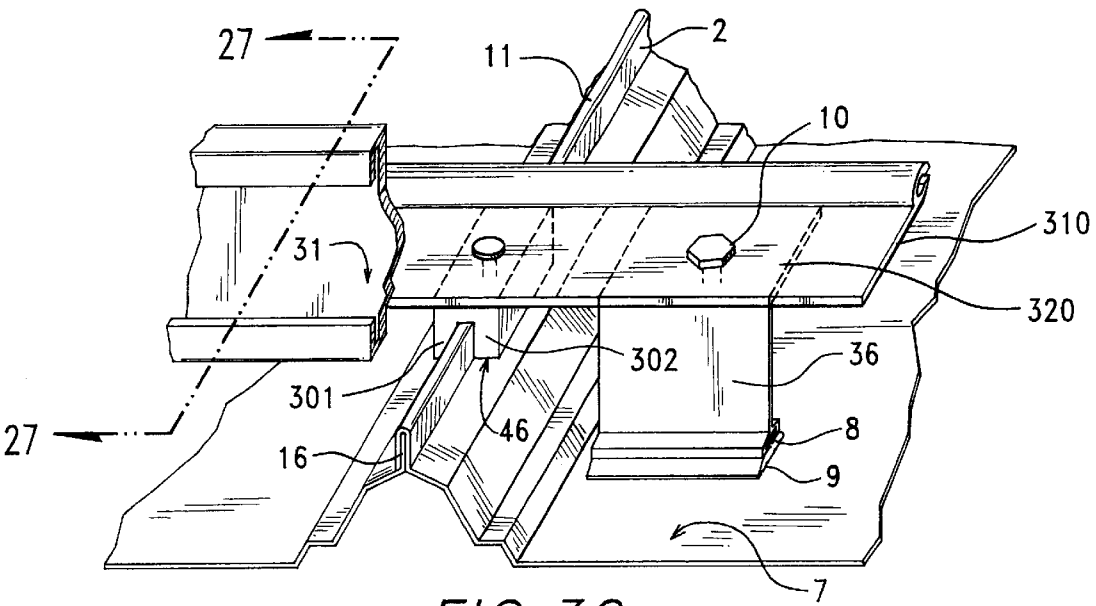
FIG. 30 is a top perspective view with a partial cutaway of an alternate embodiment bar and clamp device supporting a brace.

FIG. 23 shows a transverse bar 312 having a horizontal strut 310 which in turn has a bulbous support end 311. A brace 32 has a top flange 320 to fasten to the horizontal strut via nut and bolt 10. The foot 26 can be adjustably mounted in slot 260. FIG. 24 shows the same transverse bar 312, but the brace 33 has both a flange 320 and an arcuate socket 321 to mount on the support end 311. FIG. 25 shows the same configuration as FIG. 24, but the brace 38 is fitted with an adjustable foot 26. FIG. 26 shows the brace 35 having a right angle corner 351 abutting corner 3510 of the transverse bar 312. A flange 352 forms the foot. FIG. 27 shows the same configuration as FIG. 26 with the brace 36 fitted with a slot 8 and foot 9. FIG. 28 shows the same parts as FIG. 27, but the right angle corner 351 is mounted distally from the corner 3510. FIG. 29 shows the brace 37 to have a corner 351 mounted in the corner 3510. A flange 3211 extends from the corner 351 and ends in an arcuate channel 3210. FIG. 30 where transverse bar 31 is seen in FIGS. 23–29 and 31–34 shows an elongate clamp 46 having legs 301,302, clamp 46 securing the transverse bar 31, wherein the brace 36 prevents the panel 7 from lifting during heavy winds and prevents a rupture of the panel.

Figure 31:
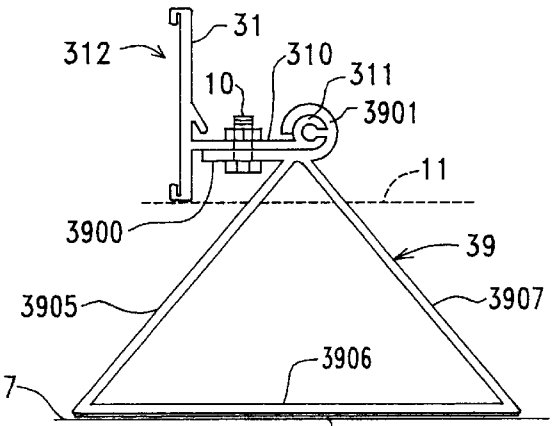
FIG. 31 is a left side plan view of an alternate embodiment brace.
Figure 32:
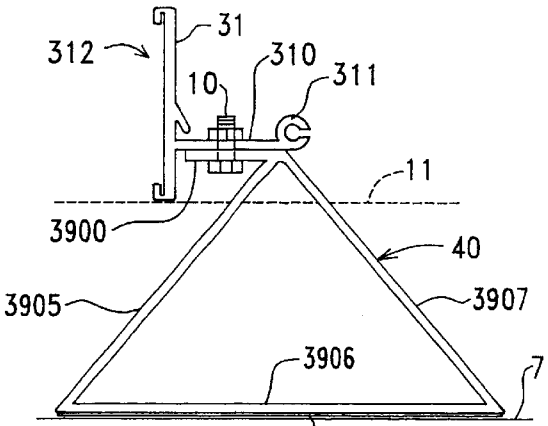
FIG. 32 is a left side plan view of an alternate embodiment brace.
Figure 33:
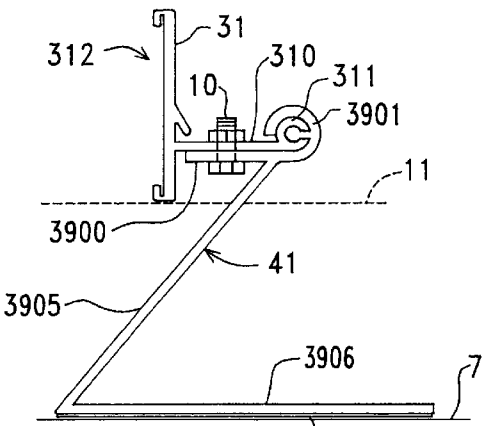
FIG. 33 is a left side plan view of an alternate embodiment a brace.
Figure 34:
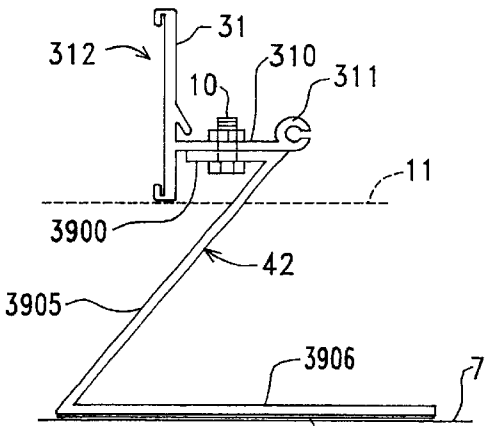
FIG. 34 is a left side plan view of an alternate embodiment brace.

In FIGS. 31–34 the same foot 3906 is connected to the same transverse bar 312 in different ways. FIG. 31 shows a triangular brace 39 with sides 3905,3907 connected to a horizontal flange 3900 which in turn has an arcuate channel 3901 mounted on support end 311. FIG. 32 deletes the arcuate channel 3901 from the FIG. 31 configuration. FIG. 33 deletes the side 3907 from the FIG. 31 configuration. FIG. 34 deletes the arcuate channel 3901 from the FIG. 33 configuration.

Figure 36:
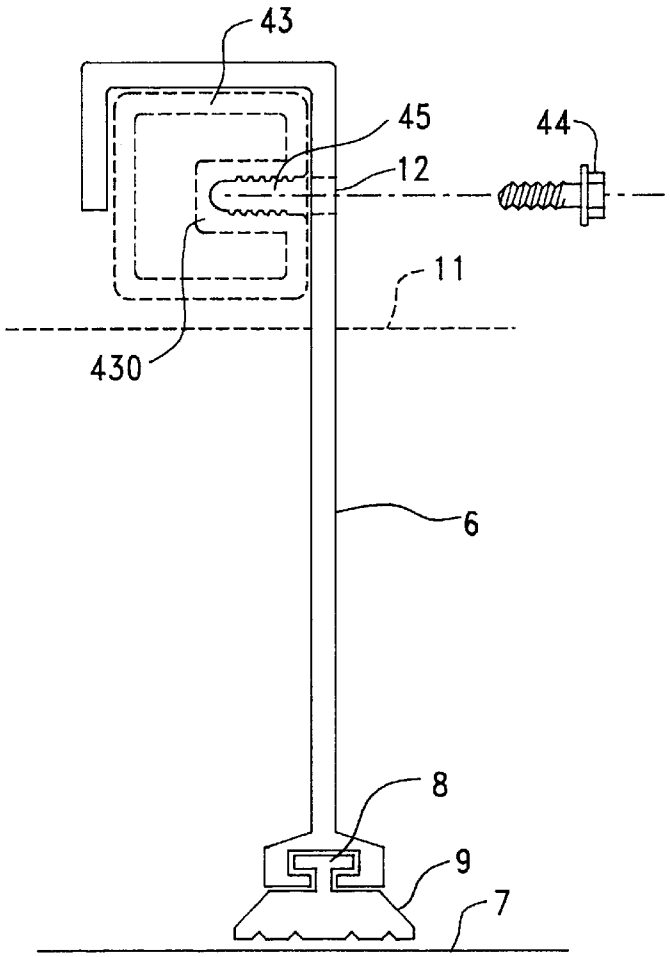
FIG. 36 is a left side plan view of the bar if FIG. 35 supporting the brace of FIG. 1.
Figure 35:
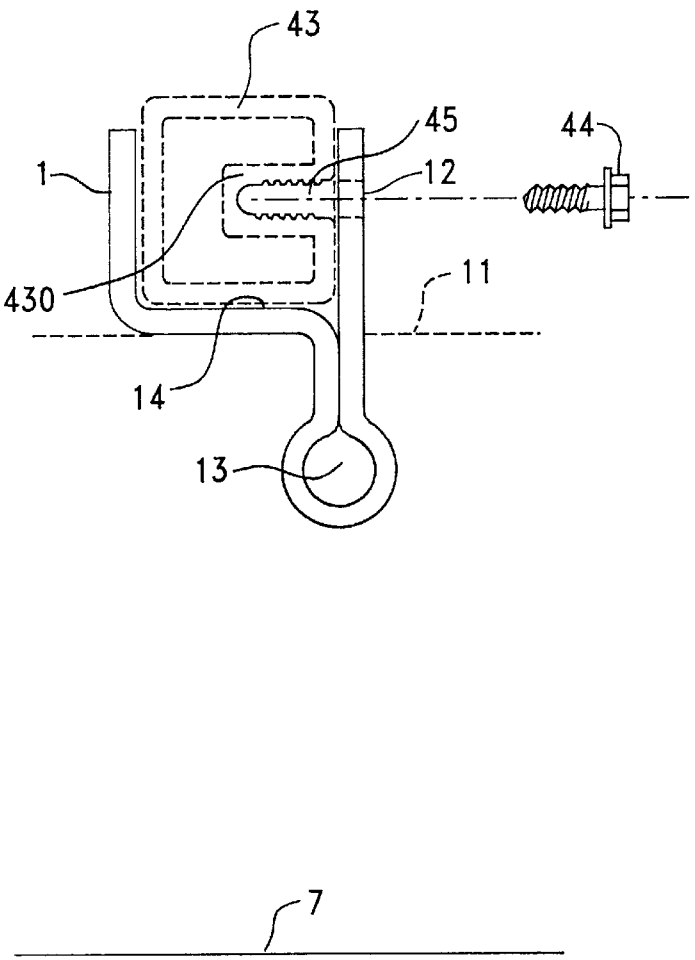
FIG. 35 is a left side plan view of an alternate embodiment bar held by the clamp of FIG. 1.

Referring next to FIGS. 35,36 a traverse rod 43 has an integral screw boss 430 and hole 45 for screw 44. The FIG. 1 configuration is shown with the traverse rod 43.

Figure 37:
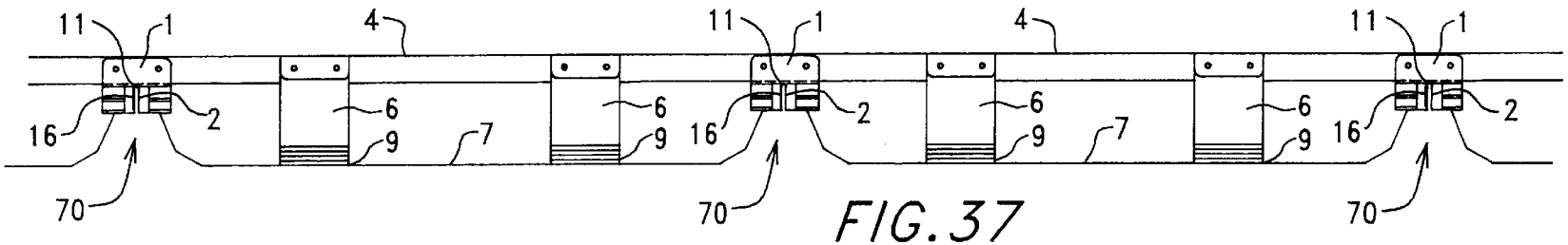
FIG. 37 is a front plan view of multi-brace embodiment using the components of FIG. 1.

Referring next to FIG. 37 the safety device 1000 can accommodate a plurality of braces 6 between each standing seam 70, based on engineering demands for varying pitches, winds, spans of seams, gauge of metals and other variables.

Figure 38:
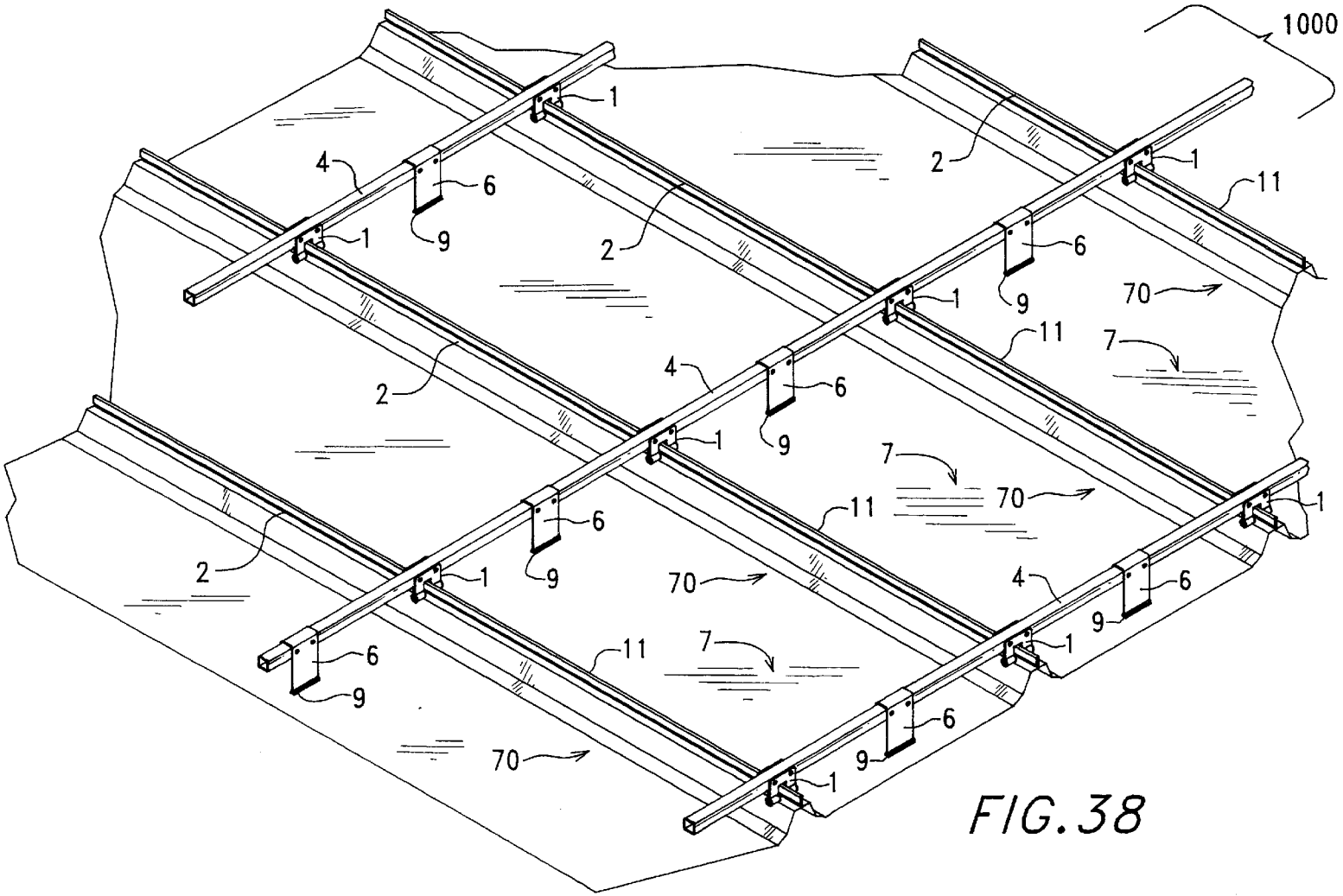
FIG. 38 is a top perspective view of the FIG. 2 preferred embodiment shown on a larger roof segment.

Referring next to FIG. 38 a typical roof section using safety device 1000 is shown to have a plurality of transverse bars 4, the number of transverse bars based on engineering demands. It is noted that each brace 6 could also serve as a snow and ice retention device along with the transverse bars 4.

Although the present invention has been described with. reference to preferred embodiments, numerous modifications and variations can be made and still the result will come within the scope of the invention. No limitation with respect to the specific embodiments disclosed herein is intended or should be inferred.

We claim:

1. A method for controlling uplift on a roof with a plurality of clamps and transverse bars, the roof being formed from a substructure, a plurality of roof panels and seams defining an interconnection between adjacent said roof panels, each of said clamps comprising a base which supports a channel, said channel supported in a transverse orientation to said seams, said channel located above a top edge of said seams, each of said transverse bars being elongated and having first and second ends, and being supported in said channel, wherein each transverse bar bridges from one seam to an adjoining seam, said method comprising the steps of:

positioning a first of said clamps on a first of said seams at a first location to receive a portion of said first seam, said first seam interconnecting first and second roof panels;

inserting at least a first of said transverse bars into said channel of said first clamp;

securing said first clamp onto said first seam, and securing a second clamp onto a second and adjacent seam;

inserting a portion of said first transverse bar in said second clamp in a channel of said second clamp;

fastening at a point on said transverse bar between said first and second seams a downward depending anti-lift brace rigidly mounted so as not to move, said brace functioning to prevent an uplift of a roof panel located between said first and second seams and to prevent a rupture of said roof panel; and wherein a foot means depends from the anti-lift brace, said foot means functioning to provide during a wind uplift a surface contact with the roof, said surface contact having a contact area greater than a contact area of a bottom edge of the anti-lift brace.

2. The method of claim 1 further comprising the step of forming the foot means on said anti-lift brace sized to withstand the wind uplift on said roof without harming said roof.

3. The method of claim 2 further comprising the step of providing a soft bottom layer on said foot means.

4. A clamp assembly for controlling uplift on a roof, said roof comprising a plurality of panels which are interconnected to define a plurality of raised seams with a substantially planar base section disposed between adjacent raised seams, said clamp assembly comprising:

a unitary mounting body comprising first and second side surfaces, upper and lower surfaces and first and second ends;

a slot integrally formed in said unitary mounting body adapted for receiving at least part of one of said raised seams, wherein when said unitary mounting body is disposed on said one raised seam, a portion of said unitary mounting body disposed furthest from an upper surface of said one raised seam is disposed at a first distance below said upper surface of said one raised seam;

said unitary mounting body further comprising an anchor;

a transverse bar between a pair of adjacent raised seams; said transverse bar supported by the anchor;

said transverse bar further comprising a downward depending brace means between the seams, said brace means functioning to prevent an uplift of a panel located between the adjacent raised seams and to prevent a rupture of said panel;

said brace means rigidly mounted at about a 90° angle to the panel so as not to move; and wherein a foot means depends from the brace means, said foot means functioning to provide during a wind uplift a surface contact with the roof, said surface contact having a contact area greater than a contact area of a bottom edge of the brace means.

5. The clamp assembly of claim 4, wherein the transverse bar further comprises a horizontal flange, and said brace means further comprises a horizontal top flange with a connection to the horizontal flange.

6. The clamp assembly of claim 5, wherein the foot means further comprises a flexible foot attached at the bottom of the brace.

7. The clamp assembly of claim 5, wherein the foot means further comprises a solid foot having a height adjustment slot.

8. The clamp assembly of claim 5, wherein the brace means further comprises a Z shaped configuration with the foot means forming a bottom of the Z.

9. The clamp assembly of claim 8, wherein the Z shaped configuration has two sides forming a triangular brace.

10. The clamp assembly of claim 4, wherein the foot means further comprises a flexible foot attached at the bottom of the brace.

11. The clamp assembly of claim 4, wherein the foot means further comprises a solid foot having a height adjustment slot.

12. The clamp assembly of claim 4, wherein the brace further comprises a Z shaped configuration with the foot means forming a bottom of the Z.

13. The clamp assembly of claim 12, wherein the Z shaped configuration has two sides forming a triangular brace.

14. The clamp assembly of claim 4, wherein the brace means further comprises a pair of vertical members connected at a selectable height, each vertical member having the foot means.

15. A method for controlling uplift on a roof with a plurality of clamps and securing members, the roof being formed from a substructure, a plurality of panels and seams defining an interconnection between adjacent said panels, each of said clamps comprising a unitary body having an integrally formed slot extending there-through and at least a first hole extending through a side portion of said unitary body to said slot, each of said securing members being elongated and having first and second ends, said method comprising the steps of:

positioning a first of said clamps on a first of said seams at a first location to receive a portion of said first seam within said slot of said first clamp, said first seam interconnecting first and second panels;

inserting at least a first of said securing members into said first hole of said first clamp to securably engage said first seam within said slot of said first clamp;

positioning a second clamp on an adjacent seam;

connecting a transverse bar above said seams on said clamps;

connecting in a rigid fashion so as not to moves a downward depending brace between said seams on said transverse bar, said brace functioning to prevent an uplift of a panel located between said first seam and said adjacent seam and to prevent a rupture of said panel; and wherein a foot means depends from the brace, said foot means functioning to provide during a wind uplift a surface contact with the roof, said surface contact having a contact area greater than a contact area of a bottom edge of the brace.

16. A clamp assembly for controlling uplift on a roof, said clamp assembly being attachable to a raised seam which interconnects adjacent roof panels on a roof, said clamp assembly comprising:

a unitary mounting body comprising first and second side surfaces, upper and lower surfaces and first and second ends;

a slot integrally formed in said unitary mounting body adapted for receiving at least part of said raised seam; at least one leg for contacting at least one of said raised seams, said leg extending from said unitary mounting body;

a securing assembly comprising a first hole extending from one of said side surfaces through said unitary mounting body to interface with said slot and a first member positionable within said first hole and being extendable within said slot to secure at least said part of said raised seam within said slot;

a cross-member having first and second ends, said cross-member being connectable to adjacent unitary mounting bodies attached to adjacent raised seams;

a flange portion extending from each of said legs of said adjacent unitary mounting bodies, said cross-member being connectable to said flange portions of said legs extending from said adjacent unitary mounting bodies, wherein said flange portion is disposed substantially 90 degrees relative to said leg;

said cross-member further comprising a downward depending segment having a depth chosen to contact or nearly contact a roof panel, to prevent an uplift of said roof panel and to prevent a rupture of said roof panel and wherein a foot means depends from the downward depending segment, said foot means functioning to provide during a wind uplift a surface contact with the roof, said surface contact having a contact area greater than a contact area greater than a contact area of a bottom edge of the downward depending segment.

17. A clamp assembly for controlling uplift on a roof, said clamp assembly being attachable to a raised seam interconnecting adjacent panels on the roof, said clamp assembly comprising:

a unitary mounting body comprising first and second side surfaces, upper and lower surfaces and first and second ends;

a slot integrally formed in said unitary mounting body and adapted for receiving at least part of one said raised seam;

a securing assembly comprising a first hole extending from one of said side surfaces of said unitary mounting body through said unitary mounting body to interface with said slot and a first member positionable within said first hole and being extendable within said slot to secure at least said part of said one said raised seam within said slot, said securing assembly further comprising a connection to a transverse bar which is mounted on top of a set of adjacent raised seams over a panel;

said transverse bar further comprising a downward depending brace between said set of adjacent raised seams, said downward depending brace mounted rigidly so as not to move and functioning to prevent uplifts of said panels and to prevent a rupture of same and wherein a foot means depends from the downward depending brace, said foot means functioning to provide during a wind uplift a surface contact with the roof, said surface contact having a contact area greater than a contact area of a bottom edge of the downward depending brace.

18. A roof panel uplift prevention system for a roof formed of a plurality of panels and seams, said seams defining an interconnection between adjacent said panels, said each seam having a top, said top being elevated a height (h) above said plurality of panels, said roof panel uplift prevention system comprising:

a first and a second clamp for attachment to adjacent seams;

a transverse bar running above said top of said seams and connected to said first and second clamps;

an uplift prevention leg mounted rigidly so as not to move and depending downward from said transverse bar between adjacent seams, thereby forming a structural abutment against a panel located between the adjacent seams at about a 90° angle to the panel for prevention of uplift of same during wind uplift pressure and for preventing damage to said panel during said wind uplift pressure.

19. The uplift prevention system of claim 18, wherein the uplift prevention leg further comprises a flexible foot.

20. The uplift prevention system of claim 18, wherein the uplift prevention leg further comprises an adjustable height mechanism.

21. The uplift prevention system of claim 18, wherein the uplift prevention leg further comprises a triangular base.

22. The uplift prevention system of claim 21, wherein the triangular base further comprises an adjustable height collar.

23. The uplift prevention system of claim 18, wherein the transverse bar further comprises an integral screw boss.

24. A clamp assembly for controlling uplift on a roof, said roof comprising a plurality of panels which are interconnected to define a plurality of raised seams with a substantially planar base section disposed between adjacent raised seams, said clamp assembly comprising:

a unitary mounting body comprising first and second side surfaces, upper and lower surfaces and first and second ends;

a slot integrally formed in said unitary mounting body adapted for receiving at least part of one of said raised seams, wherein when said unitary mounting body is disposed on said one raised seam, a portion of said unitary mounting body disposed furthest from an upper surface of said one raised seam is disposed at a first distance below said upper surface of said one raised seam;

said unitary mounting body further comprising an anchor; attaching a transverse bar between said raised seams;

said transverse bar further comprising a downward depending brace mounted rigidly so as not to move between the seams, said brace functioning to prevent an uplift of a panel located between the adjacent raised seams and to prevent a rupture of said panel; and wherein the brace further comprises a pair of vertical members connected at a selectable height.

25. A roof panel uplift prevention system for a roof formed of a plurality of panels and seams, said seams defining an interconnection between adjacent said panels, said each seam having a top, said top being elevated a height (h) above said plurality of panels, said roof panel uplift prevention system comprising:

a first and a second clamp for attachment to adjacent seams;

a transverse bar running above said top of said seams and connected to said first and second clamps;

an uplift prevention leg depending downward from said transverse bar between adjacent seams, thereby forming a structural abutment against a panel for prevention of uplift of same during wind uplift pressure and for preventing damage to said panel during said wind uplift pressure; and wherein the uplift prevention leg further comprises a triangular base.

26. The uplift prevention system of claim 25, wherein the triangular base further comprises an adjustable height collar.

27. A clamp assembly for controlling uplift on a roof, said roof comprising a plurality of panels which are interconnected to define a plurality of raised seams with a substantially planar base section disposed between adjacent raised seams, said clamp assembly comprising:

a unitary mounting body comprising first and second side surfaces, upper and lower surfaces and first and second ends;

a slot integrally formed in said unitary mounting body adapted for receiving at least part of one of said raised seams, wherein when said unitary mounting body is disposed on said one raised seam, a portion of said unitary mounting body disposed furthest from an upper surface of said one raised seam is disposed at a first distance below said upper surface of said one raised seam;

said unitary mounting body further comprising an anchor for a transverse bar between said raised seams;

said transverse bar further comprising a downward depending brace means between the seams, said brace means functioning to prevent an uplift of a said panel located between the adjacent raised seams and to prevent a rupture of said panel;

said brace means rigidly mounted at about a 90° angle to the panel so as not to move wherein the transverse bar further comprises a horizontal flange, and said brace means further comprises a horizontal top flange with a connection to the horizontal flange; and wherein the means further comprises a flexible foot attached at the bottom of the brace.

28. A clamp assembly for controlling uplift on a roof, said roof comprising a plurality of panels which are interconnected to define a plurality of raised seams with a substantially planar base section disposed between adjacent raised seams, said clamp assembly comprising:

a unitary mounting body comprising first and second side surfaces, upper and lower surfaces and first and second ends;

a slot integrally formed in said unitary mounting body adapted for receiving at least part of one of said raised seams, wherein when said unitary mounting body is disposed on said one raised seam, a portion of said unitary mounting body disposed furthest from an upper surface of said one raised seam is disposed at a first distance below said upper surface of said one raised seam;

said unitary mounting body further comprising an anchor for a transverse bar between said raised seams;

said transverse bar further comprising a downward depending brace means between the seams, said brace means functioning to prevent an uplift of a panel located between the adjacent raised seams and to prevent a rupture of said panel;

said brace means rigidly mounted at about a 90° angle to the panel so as not to move wherein the transverse bar further comprises a horizontal flange, and said brace means further comprises a horizontal top flange with a connection to the horizontal flange; and wherein the means further comprises a solid foot having a height adjustment slot.

29. A clamp assembly for controlling uplift on a roof, said roof comprising a plurality of panels which are interconnected to define a plurality of raised seams with a substantially planar base section disposed between adjacent raised seams, said clamp assembly comprising:

a unitary mounting body comprising first and second side surfaces, upper and lower surfaces and first and second ends;

a slot integrally formed in said unitary mounting body adapted for receiving at least part of one of said raised seams, wherein when said unitary mounting body is disposed on said one raised seam, a portion of said unitary mounting body disposed furthest from an upper surface of said one raised seam is disposed at a first distance below said upper surface of said one raised seam;

said unitary mounting body further comprising an anchor for a transverse bar between said raised seams;

said transverse bar further comprising a downward depending brace means between the seams, said brace means functioning to prevent an uplift of a panel located between the adjacent raised seams and to prevent a rupture of said panel;

said brace means rigidly mounted at about 90° angle to the panel so as not to move wherein the transverse bar further comprises a horizontal flange, and said brace means further comprises a horizontal top flange with a connection to the horizontal flange;

wherein the brace means further comprises a Z shaped configuration with foot forming a bottom of the Z.

30. The clamp assembly of claim 29, wherein the Z shaped configuration has two sides forming a triangular brace.

31. A clamp assembly for controlling uplift on a roof, said roof comprising a plurality of panels which are interconnected to define a plurality of raised seams with a substantially planar base section disposed between adjacent raised seams, said clamp assembly comprising:

a unitary mounting body comprising first and second side surfaces, upper and lower surfaces and first and second ends;

a slot integrally formed in said unitary mounting body adapted for receiving at least part of one of said raised seams, wherein when said unitary mounting body is disposed on said one raised seam, a portion of said unitary mounting body disposed furthest from an upper surface of said one raised seam is disposed at a first distance below said upper surface of said one raised seam;

said unitary mounting body further comprising an anchor for a transverse bar between said raised seams;

said transverse bar further comprising a downward depending brace means between the seams, said brace means functioning to prevent an uplift of a panel located between the adjacent raised seams and to prevent a rupture of said panel;

said brace means rigidly mounted at about 90° angle to the panel so as not to move wherein the means further comprises a flexible foot attached at the bottom of the brace.

32. A clamp assembly for controlling uplift on a roof, said roof comprising a plurality of panels which are interconnected to define a plurality of raised seams with a substantially planar base section disposed between adjacent raised seams, said clamp assembly comprising:

a unitary mounting body comprising first and second side surfaces, upper and lower surfaces and first and second ends;

a slot integrally formed in said unitary mounting body adapted for receiving at least part of one of said raised seams, wherein when said unitary mounting body is disposed on said one raised seam, a portion of said unitary mounting body disposed furthest from an upper surface of said one raised seam is disposed at a first distance below said upper surface of said one raised seam;

said unitary mounting body further comprising an anchor for a transverse bar between said raised seams;

said transverse bar further comprising a downward depending brace means between the seams, said brace means functioning to prevent an uplift of a panel located between the adjacent raised seams and to prevent a rupture of said panel;

said brace means rigidly mounted at about 90° angle to the panel so as not to move wherein the means further comprises a solid foot having a height adjustment slot.

33. A clamp assembly for controlling uplift on a roof, said roof comprising a plurality of panels which are interconnected to define a plurality of raised seams with a substantially planar base section disposed between adjacent raised seams, said clamp assembly comprising:

a unitary mounting body comprising first and second side surfaces, upper and lower surfaces and first and second ends;

a slot integrally formed in said unitary mounting body adapted for receiving at least part of one of said raised seams, wherein when said unitary mounting body is disposed on said one raised seam, a portion of said unitary mounting body disposed furthest from an upper surface of said one raised seam is disposed at a first distance below said upper surface of said one raised seam;

said unitary mounting body further comprising an anchor for a transverse bar between said raised seams; and said transverse bar further comprising a downward depending brace means between the seams, said brace means functioning to prevent an uplift of a panel located between the adjacent raised seams and to prevent a rupture of said panel;

said brace means rigidly mounted at about 90° angle to the panel so as not to move wherein the brace further comprises a Z shaped configuration with foot forming a bottom of the Z.

34. The clamp assembly of claim 33, wherein the Z shaped configuration has two sides forming a triangular brace.

* * * * *